US009151472B2

(12) United States Patent
Lin

(10) Patent No.: US 9,151,472 B2
(45) Date of Patent: Oct. 6, 2015

(54) LIGHT COVER CAPABLE OF ADJUSTING THE AMOUNT OF LIGHT EMITTED

(71) Applicant: Chien-Ting Lin, Santa Fe Springs, CA (US)

(72) Inventor: Chien-Ting Lin, Santa Fe Springs, CA (US)

( * ) Notice: Subject to any disclaimer, the term of this patent is extended or adjusted under 35 U.S.C. 154(b) by 134 days.

(21) Appl. No.: 14/139,788

(22) Filed: Dec. 23, 2013

(65) Prior Publication Data

US 2015/0176815 A1 Jun. 25, 2015

(51) Int. Cl.
*F21V 1/06* (2006.01)
*F21V 15/01* (2006.01)
*F21V 7/22* (2006.01)

(52) U.S. Cl.
CPC .. *F21V 15/01* (2013.01); *F21V 7/22* (2013.01)

(58) Field of Classification Search
CPC ..... F21V 15/01; F21V 7/22
USPC ..... 362/277, 278, 282, 283, 351, 352, 353, 362/355, 358, 341
See application file for complete search history.

(56) References Cited

U.S. PATENT DOCUMENTS

| | | | | |
|---|---|---|---|---|
| 6,960,004 | B1 * | 11/2005 | Hsieh | 362/450 |
| 2008/0000513 | A1 * | 1/2008 | Yul et al. | 136/245 |
| 2010/0142209 | A1 * | 6/2010 | Cuppett et al. | 362/311.08 |
| 2011/0273904 | A1 * | 11/2011 | Tajiri et al. | 362/606 |

* cited by examiner

*Primary Examiner* — Ali Alavi
(74) *Attorney, Agent, or Firm* — Lin & Associates IP, Inc.

(57) ABSTRACT

A light cover capable of adjusting the amount of light emitted is provided in the present invention. The light cover includes a cloth, a supporting frame and a binding member. The supporting frame includes three/four intersecting elastic supporting rods. A light emitting opening and a triangular/square mounting portion are formed by assembling the cloth with the three/four intersecting elastic supporting rods. The binding member is assembled with both ends of each of the three/four elastic supporting rods. By tightening the binding member around the ends of the three/four elastic supporting rods, the three/four intersecting elastic supporting rods are bent into different curvatures, thereby adjusting the size of the light emitting opening.

7 Claims, 7 Drawing Sheets

LIGHT COVER CAPABLE OF ADJUSTING THE AMOUNT OF LIGHT EMITTED

BACKGROUND OF THE INVENTION

1. Field of the Invention

The present invention relates to a structure of a light cover, more particularly, relates to a light cover capable of adjusting the amount of light emitted with a binding member.

2. The Prior Arts

Due to different demands, light covers can be used with different types of lightings, such as the chandelier at home, the lighting in the photo studio, the spotlights in the art gallery for projecting light at the art works and the light source of a projector. Light covers are commonly used in various fields for different applications. Different light reflection angles can be generated by light covers with different shapes, and different texture of light can be created by light covers with different materials. In addition, some users often put an extra mask in front of the light cover to create different effects, for example, to filter the light so as to create a softer light effect.

Normally, the users may have more than one demand when using light covers. For example, an art piece may require lighting reflected from different angles. In order to achieve such objects, various light covers are required at the same time, thereby causing inconvenience for the users in terms of space and time, and increasing the cost required for the users as well. In addition, after the user is finished using the light covers, the light cover needs to be disassembled to protect the light source from being damaged, and also to prevent the light cover from deforming as well.

SUMMARY OF THE INVENTION

Based on the above reasons, a primary objective of the present invention is to provide a light cover capable of adjusting the amount of light emitted with a binding member. After used, the light cover can be tightened with the binding structure to be stored away while protecting the light source inside thereof.

The conventional light cover can be very inconvenient to use. For example, the reflection angle of the conventional light cover cannot be regulated, thereby needing multiple light covers. In addition, the light cover needs to be disassembled in order to protect the light source from being damaged and also to prevent the light cover from deforming after use.

In order to fulfill the above objectives, a light cover capable of adjusting the amount of light emitted is provided in the present invention. The light cover includes a cloth, a supporting frame and a binding member. The supporting frame includes three/four intersecting elastic supporting rods. A light emitting opening and a triangular/square mounting portion are formed by assembling the cloth with the three/four intersecting elastic supporting rods. The binding member is assembled with both ends of each of the three/four elastic supporting rods. By tightening the binding member around the ends of the three/four elastic supporting rods, the three/four intersecting elastic supporting rods are bent into different curvatures, thereby adjusting the size of the light emitting opening.

According to an embodiment of the present invention, the cloth further includes a light reflecting layer for increasing the light reflectance of the light cover.

According to an embodiment of the present invention, the light cover further includes a light base mounting member. The light base mounting member is assembled at the mounting portion.

According to an embodiment of the present invention, the binding member includes a binding strand and a binding strand fastener. The binding strand fastener is adjustably fastened proximate to two ends of the binding strand.

According to an embodiment of the present invention, the cloth further includes a plurality of engaging loops. The engaging loops are disposed at the edge of the light emitting opening, and the binding strand is inserted through the engaging loops to secure the cloth.

According to an embodiment of the present invention, a lighting device is installed on the light base mounting member, and a light source is installed on the lighting device. When the light emitting opening is tightened by the binding member, the lighting device and the light source are quickly sheltered and protected by the light cover. The light base mounting member can be integrally formed with the lighting device, in other words, the light base mounting member is disposed on the lighting device, and is attached to the mounting portion.

With the structure provided by the present invention, the light cover is effectively improved compared with the conventional light covers. When the light cover provided by the present invention is stored away, the light source in the light cover does not need to be removed and can be sheltered directly. Since the supporting rods are made of elastic materials, the light cover can be shaped like a flower bud to shelter and protect the light source inside thereof from external impact. When the light cover needs to be carried around or transported, the light source therein can be protected from being damaged, and the number of times of the assembling/disassembling process required for the light cover can also be reduced. In short, the disadvantages and inconveniences of the conventional light cover can be improved remarkably by the light cover provided by the present invention.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

The accompanying drawings are included to provide a further understanding of the invention, and are incorporated in and constitute a part of this specification. The drawings illustrate embodiments of the invention and, together with the description, serve to explain the principles of the invention.

First Embodiment

Figure 1:
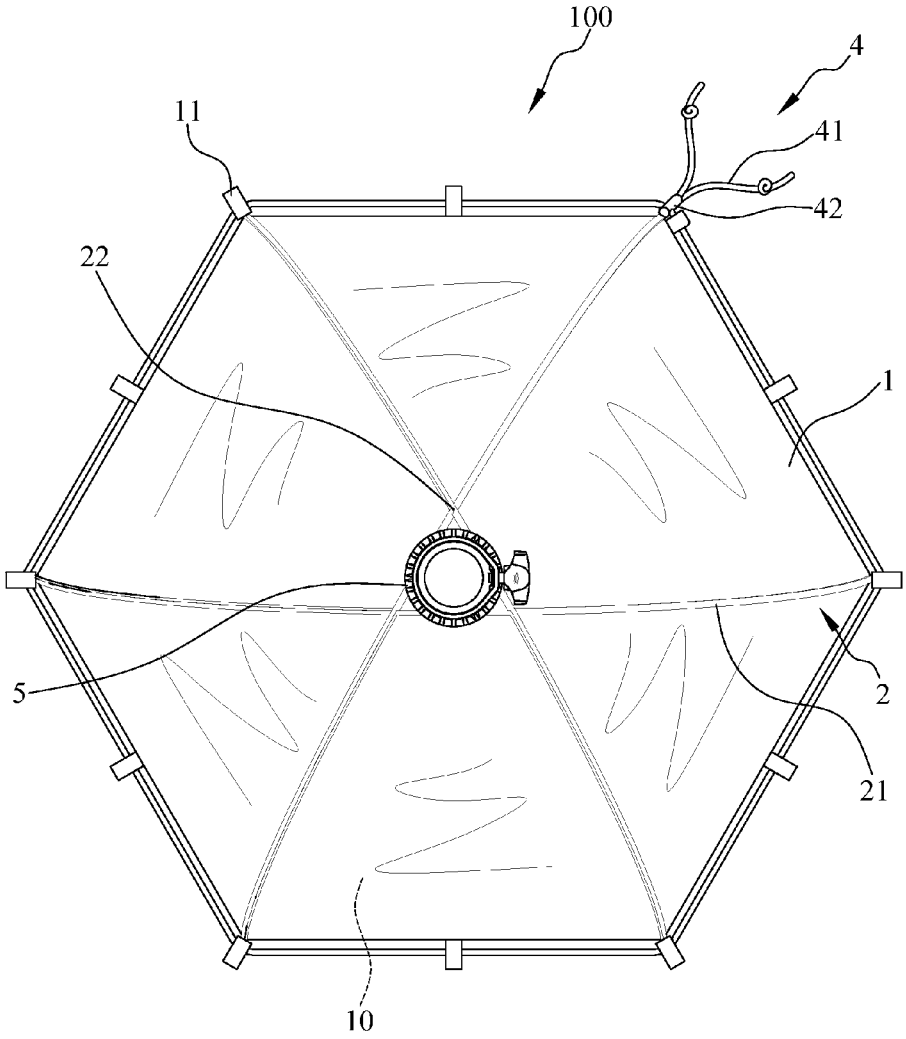
FIG. 1 is a top view showing a light cover capable of adjusting the amount of light emitted according to a first embodiment of the present invention.

FIG. 1 is a top view showing a light cover 100 capable of adjusting the amount of light emitted according to a first embodiment of the present invention. As shown in FIG. 1, the light cover 100 includes: a cloth 1, a supporting frame 2 and a binding member 4. The supporting frame 2 includes three intersecting elastic supporting rods 21. A light emitting opening 3 and a triangular mounting portion 22 are formed by assembling the cloth with the three intersecting elastic supporting rods 21. The binding member 4 is assembled with both ends of each of the three elastic supporting rods 21. By applying a force to tighten the binding member 4 around the ends of the three elastic supporting rods 21, the three intersecting elastic supporting rods 21 are bent into different curvatures, thereby adjusting the size of the light emitting opening 3.

In the first embodiment, a light base mounting member 5 is detachably attached to the supporting frame 2. The three elastic supporting rods 21 intersect with each other to form the triangular mounting portion 22, where the light base mounting member 5 is mounted on. Since the supporting frame 2 is formed by three intersecting supporting rods 21, corresponding supporting rod fitting pockets can be formed on the cloth 1. In this way, the three elastic supporting rods 21 can be fitted into the fitting pockets to assemble the three elastic supporting rods with the cloth 1.

A light reflecting layer 10 is disposed on the cloth 1. With the light reflecting layer 10, the light reflectance of the light cover 100 can be increased.

As shown in FIG. 1, the binding member 4 includes a binding strand 41 and a binding strand fastener 42. The binding strand fastener 42 is adjustably fastened proximate to two ends of the binding strand 41. The binding strand 41 is inserted through the engaging loops 11 to be assembled at the edge of the cloth 1. By adjusting the tightness of the binding strand 41, the size of the light emitting opening 3 of the light cover 100 can be finely adjusted in a stepless manner. When the light emitting opening 3 is adjusted to a desirable size, binding strand fastener 42 is used to fix the binding strand 41 so as to keep the tightness of the binding strand 41 in the desirable status.

Second Embodiment

Figure 2:
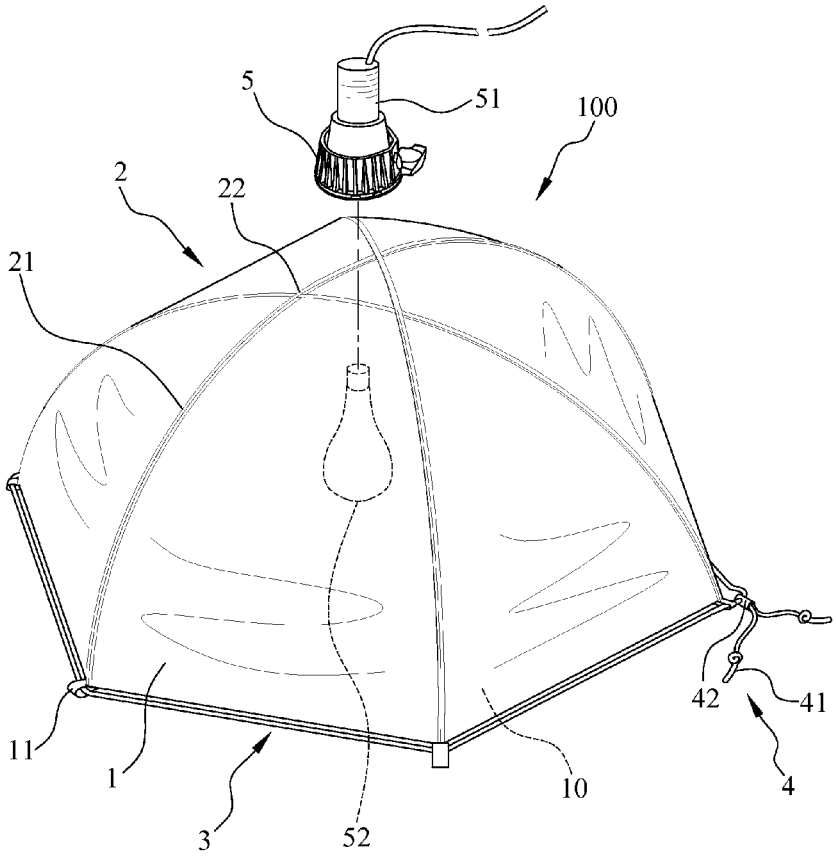
FIG. 2 is a perspective view showing a light cover according to a second embodiment of the present invention.

FIG. 2 is a perspective view showing a light cover 100 capable of adjusting the amount of light emitted according to a second embodiment of the present invention. As shown in FIG. 2, the light cover 100 includes: a cloth 1, a supporting frame 2 and a binding member 4. The supporting frame 2 includes three intersecting elastic supporting rods 21. A light emitting opening 3 and a triangular mounting portion 22 are formed by assembling the cloth with the three intersecting elastic supporting rods 21. The binding member 4 is assembled with both ends of each of the three elastic supporting rods 21. By applying a force to tighten the binding member 4 around the ends of the three elastic supporting rods 21, the three intersecting elastic supporting rods 21 are bent into different curvatures, thereby adjusting the size of the light emitting opening 3.

In the second embodiment, a light base mounting member 5 is disposed on the supporting frame 2. The three elastic supporting rods 21 intersect with each other to form the triangular mounting portion 22, where the light base mounting member 5 is mounted on. The light base mounting member 5 can be use to fit and clamp a lighting device 51. Since the supporting frame 2 is formed by three intersecting supporting rods 21, corresponding supporting rod fitting pockets can be formed on the cloth 1. In this way, the three elastic supporting rods can be fitted into the fitting pockets to assemble the three elastic supporting rods with the cloth 1.

A light reflecting layer 10 is disposed on the cloth 1. With the light reflecting layer 10, the light reflectance of the light cover 100 can be increased.

As shown in FIG. 2, the binding member 4 includes a binding strand 41 and a binding strand fastener 42. The binding strand fastener 42 is adjustably fastened proximate to two ends of the binding strand 41. The binding strand 41 is inserted through the engaging loops 11 to be assembled at the edge of the cloth 1. By adjusting the tightness of the binding strand 41, the size of the light emitting opening 3 of the light cover 100 can be finely adjusted in a stepless manner. When the light emitting opening 3 is adjusted to a desirable size, binding strand fastener 42 is used to fix the binding strand 41 so as to keep the tightness of the binding strand 41 in the desirable status.

In the second embodiment, the light base mounting member 5 can be directly formed on the lighting device 51. In other words, the light base mounting member 5 is integrally formed with the lighting device 51. In this way, the light cover 100 has a wider range of application, since the light cover 100 can be adjusted according to different demands of the users.

By tightening/loosening the binding strand 41 of the binding member 4, the size of the light emitting opening 3 can be shrunk/expanded, thereby adjusting the amount of light emitted. After the user is done using the light cover 100, the binding strand 41 of the binding member 4 can be tightened to its tightest state, and the light cover 100 is ready to be stored away.

Variation of the Second Embodiment

Figure 3:
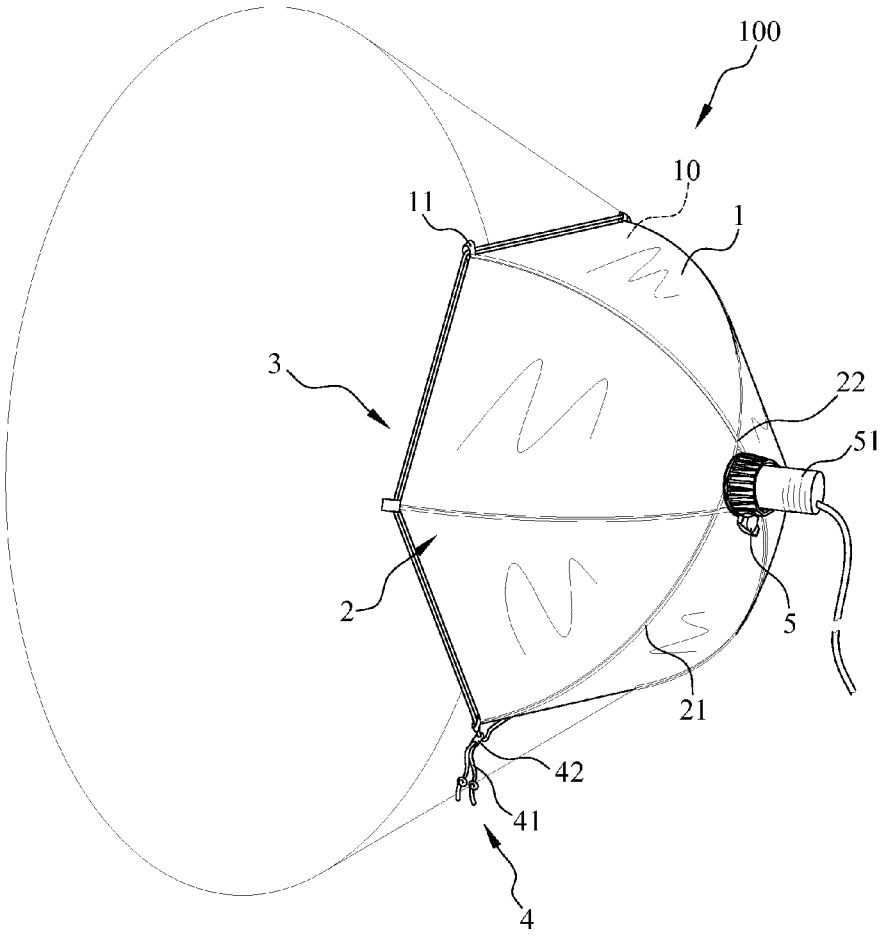
FIG. 3 is a perspective view showing a variation of the light cover according to the second embodiment of the present invention.
Figure 4:
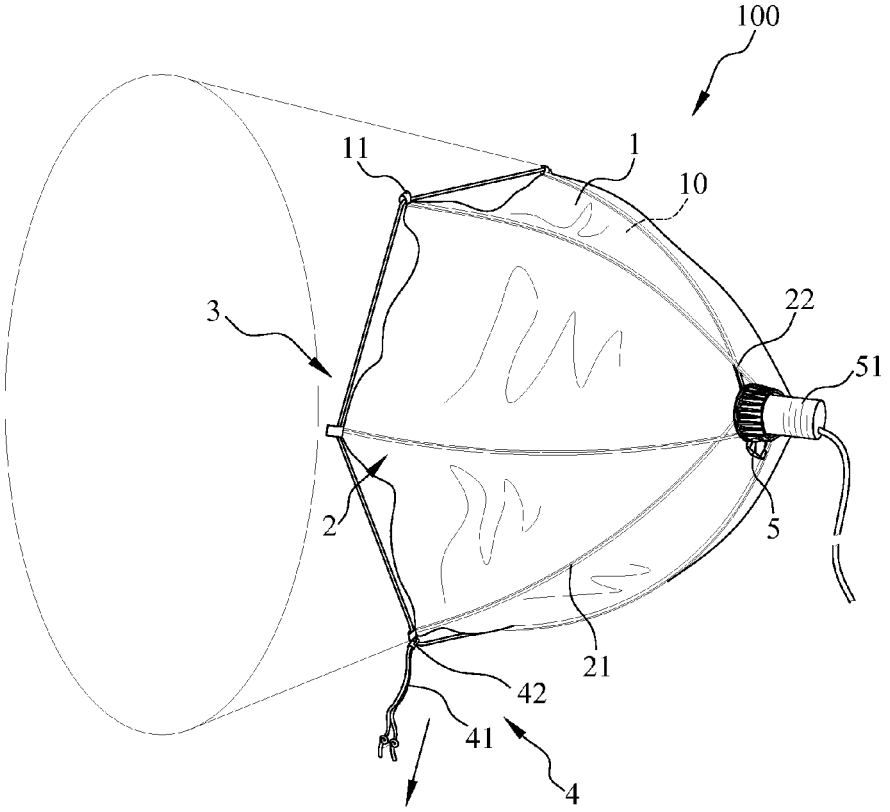
FIG. 4 is a perspective view showing the variation of the light cover according to the second embodiment of the present invention.
Figure 5:
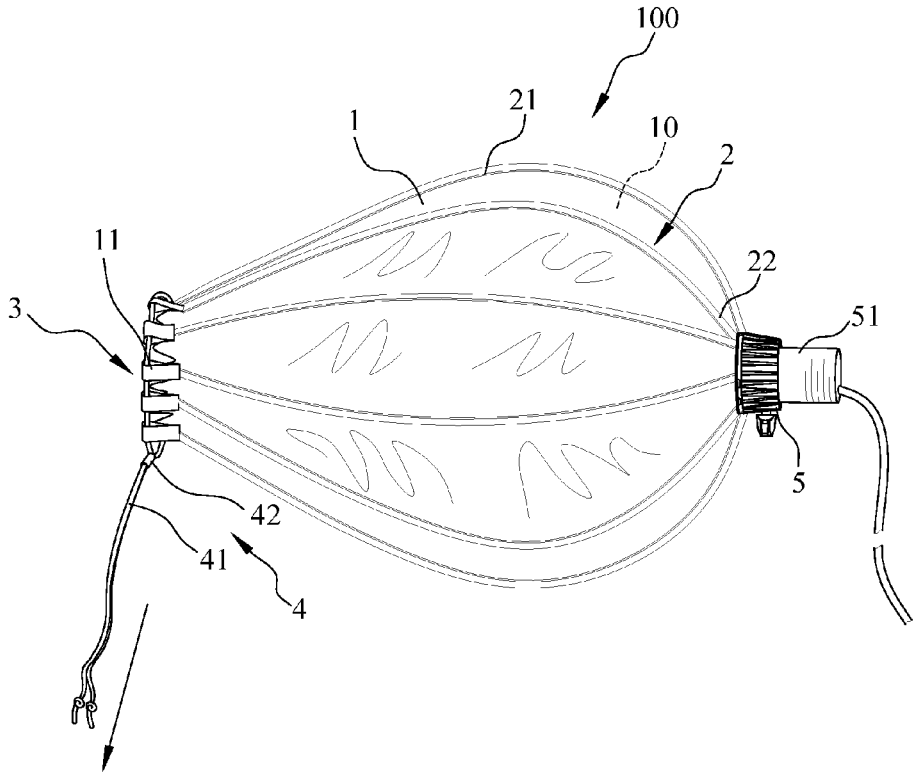
FIG. 5 is a side view showing the variation of the light cover according to the second embodiment of the present invention.

FIG. 3, FIG. 4 and FIG. 5 illustrated a variation of light cover according to the second embodiment of the present invention. Similar to the situation in the second embodiment where the elastic supporting rods 21 intersect with each other, the light cover 100 includes: a cloth 1, a supporting frame 2 and a binding member 4. The supporting frame 2 includes three intersecting elastic supporting rods 21. A light emitting opening 3 and a triangular mounting portion 22 are formed by assembling the cloth with the three intersecting elastic supporting rods 21. The binding member 4 is assembled with both ends of each of the three elastic supporting rods 21. By applying a force to tighten the binding member 4 around the ends of the three elastic supporting rods 21, the three intersecting elastic supporting rods 21 are bent into different curvatures, thereby adjusting the size of the light emitting opening 3.

In the second embodiment, a light base mounting member 5 is disposed on the supporting frame 2. The three elastic supporting rods 21 intersect with each other to form the triangular mounting portion 22, where the light base mounting member 5 is mounted on. The light base mounting member 5 can be use to fit and clamp a lighting device 51. Since the supporting frame 2 is formed by three intersecting supporting rods 21, supporting rod fitting pockets can be formed on the cloth 1. In this way, the three elastic supporting rods can be fitted into the fitting pockets to assemble the three elastic supporting rods with the cloth 1.

A light reflecting layer 10 is disposed on the cloth 1. With the light reflecting layer 10, the light reflectance of the light cover 100 can be increased.

As shown in FIG. 2, the binding member 4 includes a binding strand 41 and a binding strand fastener 42. The binding strand fastener 42 is adjustably fastened proximate to two ends of the binding strand 41. The binding strand 41 is inserted through the engaging loops 11 to be assembled at the edge of the cloth 1. By adjusting the tightness of the binding strand 41, the size of the light emitting opening 3 of the light cover 100 can be finely adjusted in a stepless manner. When the light emitting opening 3 is adjusted to a desirable size, binding strand fastener 42 is used to fix the binding strand 41 so as to keep the tightness of the binding strand 41 in the desirable status.

FIG. 3 illustrates the light cover 100 of the second embodiment in a state which the light is emitting. A stand can be attached to a tail section of the lighting device 51. As shown in FIG. 3, after the binding strand 41 of the binding member 4 is tightened, the shape of the light cover 100 is also gradually and finely adjusted in a stepless manner.

As shown in FIG. 4, the illuminating range of the light cover 100 concentrates as the stepless fine adjustment process continues. Such adjustment process of the present invention provides more application choices for the users, so the user does not need to switch between different light covers.

As shown in FIG. 5, when the binding strand 41 of the binding member 4 is tightened to its tightest state, the light cover 100 is ready to be stored away directly. In addition, the lighting device 1 and the light source 52 can be sheltered and protected without needing to remove them from the light cover 100.

When the light cover provided by the present invention is stored away, the light source in the light cover does not need to be removed and can be sheltered directly. Since the supporting rods are made of elastic materials, the light cover can be shaped like a flower bud to shelter and protect the light source inside thereof from external impact. When the light cover needs to be carried around or transported, the light source therein can be protected from being damaged, and the number of times of the assembling/disassembling process required for the light cover can also be reduced. In short, the disadvantages and inconveniences of the conventional light cover can be improved remarkably by the light cover provided by the present invention.

Third Embodiment

Figure 6:
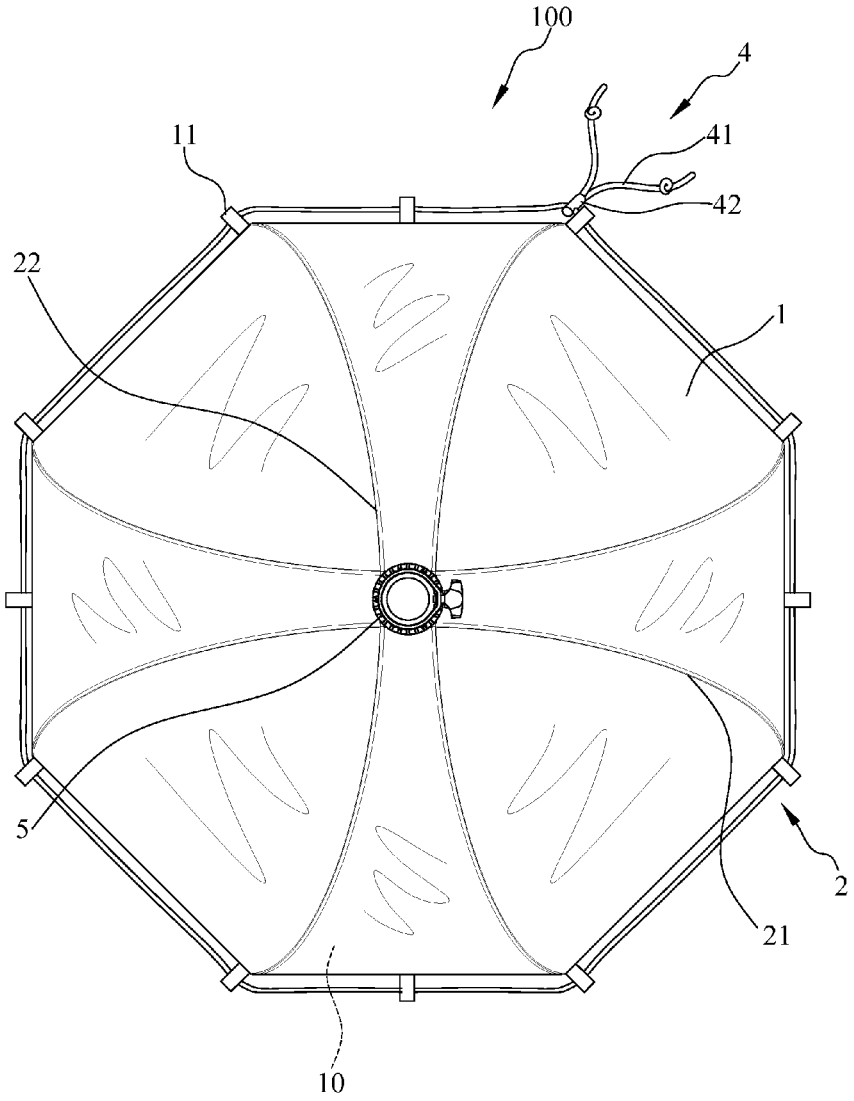
FIG. 6 is a top view showing a light cover according to a third embodiment of the present invention.
Figure 7:
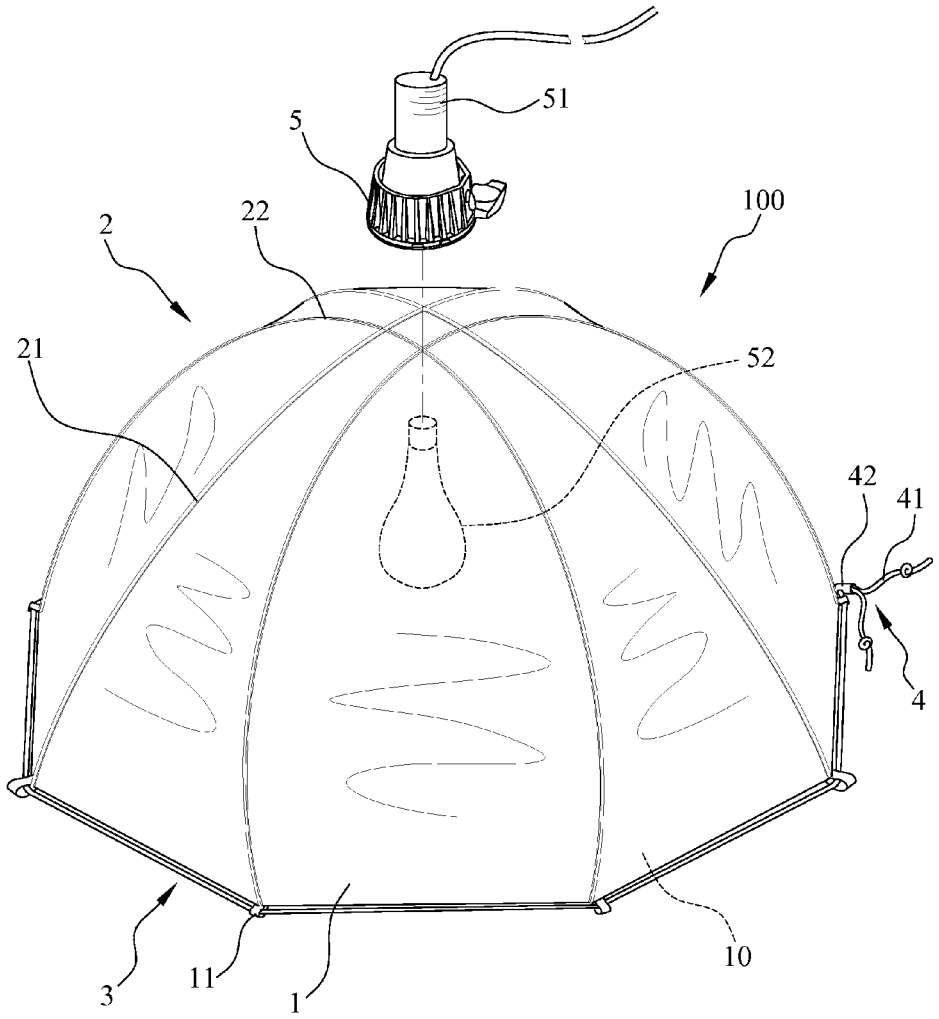
FIG. 7 is a perspective view showing a light cover according to a fourth embodiment of the present invention.

FIG. 6 and FIG. 7 illustrated the light cover 100 capable of adjusting the amount of light emitted according to a third embodiment of the present invention. The light cover 100 according to the third embodiment has a similar structure with the previous embodiments. As shown in FIG. 6, the light cover 100 includes: a cloth 1, a supporting frame 2 and a binding member 4. The supporting frame 2 includes four intersecting elastic supporting rods 21. A light emitting opening 3 and a rectangular mounting portion 22 are formed by assembling the cloth with the four intersecting elastic supporting rods 21. The binding member 4 is assembled with both ends of each of the four elastic supporting rods 21. By applying a force to tighten the binding member 4 around the ends of the four elastic supporting rods 21, the four intersecting elastic supporting rods 21 are bent into different curvatures, thereby adjusting the size of the light emitting opening 3.

As shown in FIG. 7, a light base mounting member 5 is further disposed on the supporting frame 2. Different from the previous embodiments, the supporting frame 2 according to the third embodiment includes four elastic supporting rods 21. The four elastic supporting rods 21 intersect with each other to form the rectangular mounting portion 22, where the light base mounting member 5 is mounted on. The light base mounting member 5 can be use to fit and clamp a lighting device 51. Since the supporting frame 2 is formed by four intersecting supporting rods 21, corresponding supporting rod fitting pockets can be formed on the cloth 1. In this way, the four elastic supporting rods can be fitted into the fitting pockets to assemble the four elastic supporting rods 21 with the cloth 1.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A light cover capable of adjusting the amount of light emitted, comprising:

a cloth;

a supporting frame, having three/four intersecting elastic supporting rods, wherein, a light emitting opening and a triangular/square mounting portion are formed by assembling the cloth with the three/four intersecting elastic supporting rods; and a binding member, being assembled with both ends of each of the three/four elastic supporting rods;

wherein, by tightening the binding member around the ends of the three/four elastic supporting rods, the three/four elastic supporting rods are bent into different curvatures, thereby adjusting the size of the light emitting opening.

2. The light cover according to claim 1 further comprising a light base mounting member, wherein the light base mounting member is assembled at the mounting portion.

3. The light cover according to claim 1, wherein the cloth further includes a light reflecting layer.

4. The light cover according to claim 1, wherein the binding member includes a binding strand and a binding strand fastener, and the binding strand fastener is adjustably fastened proximate to two ends of the binding strand.

5. The light cover according to claim 4, wherein the cloth further includes a plurality of engaging loops, the engaging loops are disposed at the edge of the light emitting opening, and the binding strand is inserted through the engaging loops to secure the cloth.

6. The light cover according to claim 2, wherein a lighting device is installed on the light base mounting member, and a light source is installed on the lighting device, wherein when the light emitting opening is tightened by the binding member, the lighting device and the light source are quickly sheltered and protected by the light cover.

7. The light cover according to claim 6, wherein the light base mounting member is disposed on the lighting device, and is detachably attached to the mounting portion.

* * * * *